US011358772B2

(12) United States Patent
Miura et al.

(10) Patent No.: US 11,358,772 B2
(45) Date of Patent: Jun. 14, 2022

(54) SPOUTED POUCH

(71) Applicant: Toyo Seikan Co., Ltd., Tokyo (JP)

(72) Inventors: Takashi Miura, Yokohama (JP); Masashi Ishikawa, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 16/398,862

(22) Filed: Apr. 30, 2019

(65) Prior Publication Data

US 2019/0256269 A1 Aug. 22, 2019

Related U.S. Application Data

(63) Continuation of application No. PCT/JP2017/037630, filed on Oct. 18, 2017.

(30) Foreign Application Priority Data

Nov. 7, 2016 (JP) ..... JP2016-217260
Feb. 9, 2017 (JP) ..... JP2017-022236
Feb. 27, 2017 (JP) ..... JP2017-034525

(51) Int. Cl.
*B65D 75/58* (2006.01)
*B65D 75/56* (2006.01)

(52) U.S. Cl.
CPC ..... *B65D 75/5883* (2013.01); *B65D 75/566* (2013.01)

(58) Field of Classification Search
CPC ..... B65D 75/5883; B65D 75/566; B65D 75/008; B65D 75/5861; B65D 75/5822;
(Continued)

(56) References Cited

U.S. PATENT DOCUMENTS

2004/0197030 A1* 10/2004 Rosn ..... B65D 75/5822 383/36
2006/0165927 A1* 7/2006 Harano et al. ..... B65D 75/008 428/35.2
(Continued)

FOREIGN PATENT DOCUMENTS

JP 5-82839 U 11/1993
JP 2002-211589 A 7/2002
(Continued)

OTHER PUBLICATIONS

International Search Report dated Jan. 16, 2018, issued in counterpart application No. PCT/JP2017/037630 (2 pages).
(Continued)

*Primary Examiner* — Paul R Durand
*Assistant Examiner* — Michael J. Melaragno
(74) *Attorney, Agent, or Firm* — WHDA, LLP

(57) ABSTRACT

Provided is a spouted pouch capable of improving the ability to suspend pouring liquid contents, the ease of adjusting a pouring force, and the ease of repouring. In the spouted pouch (10), a pouch body (20) has flow path control seal portions (22) formed on both left and right sides across an imaginary line A inside the outer edge seal portion (21). Assuming that a thickness dimension of the spout attachment base portion (31*a*) is taken as X, length dimension from the spout attachment base portion (31*a*) to the action point portion (22*a*) of flow path control seal portions (22) is taken as L, and a width dimension between the action point portions (22*a*) is taken as W, the thickness dimension X, the length dimension L, and the width dimension W are set so as to satisfy relationships of W/X=1.2 to 2.0 and L/X=0.3 to 1.5.

14 Claims, 11 Drawing Sheets

(58) Field of Classification Search
CPC ..... B65D 75/5866; B65D 75/5872; B65D 75/5877; B65D 2575/58; B65D 2575/583
USPC ..... 383/43, 49; 222/92
See application file for complete search history.

(56) References Cited

U.S. PATENT DOCUMENTS

| | | | | |
|---|---|---|---|---|
| 2007/0071363 | A1* | 3/2007 | DeBlander et al. | B65D 33/14 383/9 |
| 2007/0175920 | A1* | 8/2007 | Takada et al. | B65D 75/5866 222/107 |
| 2007/0177828 | A1* | 8/2007 | Takada | B65D 75/5822 383/200 |
| 2007/0201771 | A1* | 8/2007 | Takada | B65D 75/5822 383/35 |
| 2008/0124006 | A1* | 5/2008 | Yamaguchi | B65D 75/008 383/9 |
| 2008/0142085 | A1* | 6/2008 | Burkard | B65D 75/5883 137/1 |
| 2011/0075954 | A1* | 3/2011 | Kumar | B65D 75/5866 383/204 |
| 2014/0270580 | A1* | 9/2014 | Thomas, Jr. | B65D 75/5805 383/26 |
| 2015/0360839 | A1* | 12/2015 | Murray | B65D 75/008 383/7 |
| 2016/0052705 | A1* | 2/2016 | Murray | B65D 85/72 206/277 |
| 2017/0043926 | A1* | 2/2017 | Futase | B65D 75/5883 |
| 2017/0144800 | A1* | 5/2017 | Lucchese | G09F 3/08 |
| 2018/0346217 | A1* | 12/2018 | Testa | B65D 75/008 |
| 2019/0021279 | A1* | 1/2019 | Dumm | A01K 7/00 |
| 2020/0031527 | A1* | 1/2020 | Koesters | B65D 33/004 |

FOREIGN PATENT DOCUMENTS

| | | | | |
|---|---|---|---|---|
| JP | 2002211589 | A | * | 7/2002 |
| JP | 2003-137318 | A | | 5/2003 |
| JP | 2004-338760 | A | | 12/2004 |
| JP | 2007-91270 | A | | 4/2007 |
| JP | 2007-186222 | A | | 7/2007 |
| JP | 2007186222 | A | * | 7/2007 |
| JP | 2008-37471 | A | | 2/2008 |
| JP | 2008-127059 | A | | 6/2008 |
| JP | 2010-228764 | A | | 10/2010 |
| JP | 2012-206780 | A | | 10/2012 |
| JP | 2014069314 | A | | 4/2014 |
| JP | 2014-118195 | A | | 6/2014 |
| JP | 2015-63332 | A | | 4/2015 |
| JP | 2017-65747 | A | | 4/2017 |
| WO | 2011/043149 | A1 | | 4/2011 |
| WO | 2012/090536 | A1 | | 7/2012 |

OTHER PUBLICATIONS

Extended (Supplementary) European Search Report dated Jun. 17, 2020, issued in counterpart EP Application No. 17867150.9. (7 pages).

Office Action dated Jan. 5, 2021, issued in counterpart Japanese Application No. 2019-000960 (6 pages; w/English translation).

* cited by examiner

WITH UNSEALED PORTION

| | | WIDTH W | | | | | |
|---|---|---|---|---|---|---|---|
| | | x1.0(12mm) | x1.2(14mm) | x1.5(18mm) | x1.6(19mm) | x2.0(23mm) | x2.2(26mm) |
| LENGTH L | x0.2(2mm) | ×/○ | ×/○ | ×/○ | ×/○ | ×/○ | ×/○ |
| | x0.3(4mm) | ○/× | ○/○ | ○/○ | ○/○ | ○/○ | ×/○ |
| | x0.4(5mm) | ○/× | ○/○ | ○/○ | ○/○ | ○/○ | ×/○ |
| | x0.9(11mm) | ○/× | ○/○ | ○/○ | ○/○ | ○/○ | ×/○ |
| | x1.5(18mm) | ○/× | ○/○ | ○/○ | ○/○ | ○/○ | ×/○ |
| | x1.7(20mm) | ○/× | ○/× | ○/× | ○/× | ○/× | ×/○ |

※「ABILITY TO INTERRUPT / EASE OF REPOURING」

NO UNSEALED PORTION

| | | WIDTH W | | | | | |
|---|---|---|---|---|---|---|---|
| | | x1.0(12mm) | x1.2(14mm) | x1.5(18mm) | x1.6(19mm) | x2.0(23mm) | x2.2(26mm) |
| LENGTH L | x0.2(2mm) | ×/○ | ×/○ | ×/○ | ×/○ | ×/○ | ×/○ |
| | x0.3(4mm) | ○/× | ○/○ | ○/○ | ○/○ | ○/○ | ×/○ |
| | x0.4(5mm) | ○/× | ○/○ | ○/○ | ○/○ | ○/○ | ×/○ |
| | x0.9(11mm) | ○/× | ○/△ | ○/△ | ○/○ | ○/○ | ×/○ |
| | x1.5(18mm) | ○/× | ○/△ | ○/△ | ○/△ | ○/○ | ×/○ |
| | x1.7(20mm) | ○/× | ○/× | ○/× | ○/× | ○/× | ×/○ |

※「ABILITY TO INTERRUPT / EASE OF REPOURING」

Fig. 5

SPOUTED POUCH

TECHNICAL FIELD

The present invention relates to a spouted pouch in which a spout is attached to a pouch body.

Conventionally, a spouted pouch in which a spout serving as a pouring outlet is attached to a pouch body formed by laminating films is widely used in applications for a refill container for storing liquid contents such as detergent and shampoo with which a container of a product (a refill destination container) is refilled, and the like.

In recent years, in applications for refill containers, large-sized spouted pouches containing liquid contents in a volume which is more than a predetermined capacity of the container of the product, that is, a volume enabling multiple times of refilling, have become popular. In such a large-sized spouted pouch, when the container of the product is refilled, it may be necessary to temporarily stop pouring liquid contents in order to prevent liquid contents in the spouted pouch from jumping out of the container of the product and to prevent jumped-out liquid contents from knocking the container of the product, or to confirm the amount of liquid in the container of the product during the refilling work.

Then, when pouring liquid contents is temporarily stopped, it is common to adjust the attitude of the spouted pouch so that the pouring is stopped, such as turning the spout upward each time. However, it is troublesome for the user to repeat such operations and repeating the refilling operation also increases the risk of knocking the product. Accordingly, there is a demand for a function to temporarily stop poring liquid contents without changing the attitude of the spouted pouch.

A mechanism for temporarily stopping pouring liquid contents as described above is known as disclosed in Patent Literature 1. In the mechanism, a narrowed portion in which the interval between seal portions is narrowed is formed at a position apart from a spout functioning as a pouring outlet to some extent, and the narrowed portion is gripped on the front and back of the pouch body with fingers of a user to temporarily stop poring liquid contents.

CITATION LIST

Patent Literature

Patent Literature 1: Japanese Patent Application Publication No. 2008-37471

SUMMARY OF INVENTION

Technical Problem

However, in the mechanism disclosed in Patent Literature 1, when the narrowed portion in which the interval between the seal portions is narrowed is griped in order to temporarily stop poring liquid contents, the front and back films of the narrowed portion are brought into close contact with each other. For this reason, when it is attempted to resume pouring liquid contents, there is a possibility that the close contact of the front and back films is not released and the pourability of the liquid contents is thus lowered.

Therefore, the present invention has been made to solve these problems, and it is an object of the present invention to provide a spouted pouch capable of improving the ability to suspend pouring liquid contents, the ease of adjusting a pouring force, and the ease of repouring.

Solution to Problem

To solve the above problems, the present invention provides a spouted pouch in which a pouch is attached to a pouch body, wherein the pouch body has an outer edge seal portion and a pair of flow path control seal portions that are formed on both left and right sides across an imaginary line extending along a center axis of the spout body inside the outer edge seal portion, each of the flow path control seal portions has an action point portion that is located at a position farthest from the spout body in an extending direction of the imaginary line, out of portions closest to the imaginary line, the spout has a spout attachment base portion that is attached to a part of the outer edge seal portion such that the spout attachment base portion is interposed between front and back films composing the pouch body, and assuming that a thickness dimension of the spout attachment base portion in a direction orthogonally crossing a plane direction of the pouch body is taken as X, a length dimension from the spout attachment base portion to the action point portion in the extending direction of the imaginary line is taken as L, and a width dimension between the action point portions of the pair of flow path control seal portions in a direction orthogonally crossing the imaginary line is taken as W, the thickness dimension X, the length dimension L, and the width dimension W are set so as to satisfy relationships of $W/X=1.2$ to 2.0 and $L/X=0.3$ to 1.5.

To solve the above problems, another aspect of the present invention provides a spouted pouch in which a spout is attached to a pouch body, wherein the pouch body has an outer edge seal portion and a pair of flow path control seal portions that are formed on both left and right sides across an imaginary line extending along a center axis of the spout body inside the outer edge seal portion, wherein an unsealed portion is formed at a position adjacent to a side portion of at least one of the flow path control seal portions on an opposite side to the imaginary line in the direction orthogonally crossing the imaginary line

Advantageous Effects of Invention

According to one aspect of the present invention, the pair of flow path control seal portions are formed on both left and right sides across the imaginary line extending from the center axis of the spout body inside the outer edge seal portion, thereby making it possible to restrict an open portion in which the front and back films are separated, in an outer edge of a film spaced region in which the front and back films are spaced from each other due to a thickness of the spout attachment base described later, to the tip side of the outer edge of the film spaced region far from the spout. Therefore, it is possible to satisfactorily perform temporary stop of pouring of liquid contents (the ability to suspend pouring), the ease of adjusting a pouring force, and the like by gripping the tip side of the outer edge of the film spaced region with fingers. Not only that, the invention has the following advantageous effects.

That is, according to the invention as in 1, assuming that the thickness dimension of the spout attachment base portion is taken as X, the length dimension from the spout attachment base portion to the action point portion is taken as L, and the width dimension between the action point portions of the pair of flow path control seal portions is taken as W, the thickness dimension X, the length dimension L, and the width dimension W are set to satisfy relationships of W/X=1.2 to 2.0 and L/X=0.3 to 1.5, thereby making it possible to improve the ability to suspend the pouring the liquid contents by gripping the tip side of the outer edge of the film spaced region with fingers, and the ease of repouring the liquid contents when gripping with the fingers is released to restart pouring of liquid content.

According to another aspect of the present invention, it is possible to more reliably ensure the ability to suspend poring liquid contents and the ease of repouring the liquid contents.

According to another aspect of the present invention, an unsealed portion is formed at a position adjacent to a side portion of at least one of the flow path control seal portions on an opposite side to the imaginary line in the direction orthogonally crossing the imaginary line, thereby making it easy for the front and back films to separate from each other on the tip side of the outer edge of the film spaced region because of the effect of expansion of the unsealed portion wherein the liquid contents entering the unsealed portion expand the unsealed portion when poring liquid contents is performed. Therefore, it is possible to ensure satisfactory pourability of the liquid contents, and in particular, to improve the ease of repouring the liquid contents when poring liquid contents is restarted.

According to another aspect of the present invention, the unsealed portion is formed at a position adjacent to the side portion of one of the pair of flow path control seal portions on the opposite side to the imaginary line, thereby making it possible to improve the ability to suspend the pouring and the ease of repouring the liquid contents and also to allow satisfactory refilling work without residual liquid of the liquid contents remaining in the unsealed portion inside the pouch when the product is refilled with the liquid contents of the spouted pouch.

According to another aspect of the present invention, the unsealed portion is each formed at positions adjacent to the both side portions of the respective flow path control seal portions on opposite sides to the imaginary line, thereby making it possible to allow the liquid contents to enter at least one of the pair of unsealed portions irrespective of the degree of the tilt of spouted pouch when poring liquid contents is performed. Therefore, it is possible to stably obtain the effect of improving the pourability due to the expansion of the unsealed portions.

According to another aspect of the present invention, each of the flow path control seal portions is formed continuously with an attachment seal portion that is formed along an attachment edge portion to which the spout is attached, thereby making it possible to stably ensure the adhesion strength between the front and back films at each of the flow path control seal portions and also to prevent the liquid contents from leaking into the inside of the film spaced region from between the flow path control seal portion and the attachment seal portion when poring liquid contents is stopped.

According to another aspect of the present invention, a position mark indicating a position to be pressed with the finger is formed, thereby making it possible to securely press an optimal position on the tip side of the outer edge of the film spaced region with the finger or release the position when poring liquid contents is suspended or when repouring of liquid contents is performed.

According to another aspect of the present invention, the spout is attached at an upper edge portion, a first side edge portion, or an oblique edge portion that is formed by cutting a corner between the upper edge portion and the first side edge portion, and a gripping portion indicating a grip position of the spouted pouch for the user is provided at a second side edge seal portion. This makes it possible to guide the user on how to hold the spouted pouch to grip the tip side of the outer edge of the film spaced region described above in the vicinity of the spout with the fingers while the user lifts the spouted pouch. Therefore, the user can easily operate temporary stop of poring liquid contents and restart of poring liquid contents.

BRIEF DESCRIPTION OF DRAWINGS

FIG. 5 is an explanatory view illustrating an experimental result of an experiment for evaluating the performance of the spouted pouch.

REFERENCE SIGNS LIST

Figure 1:
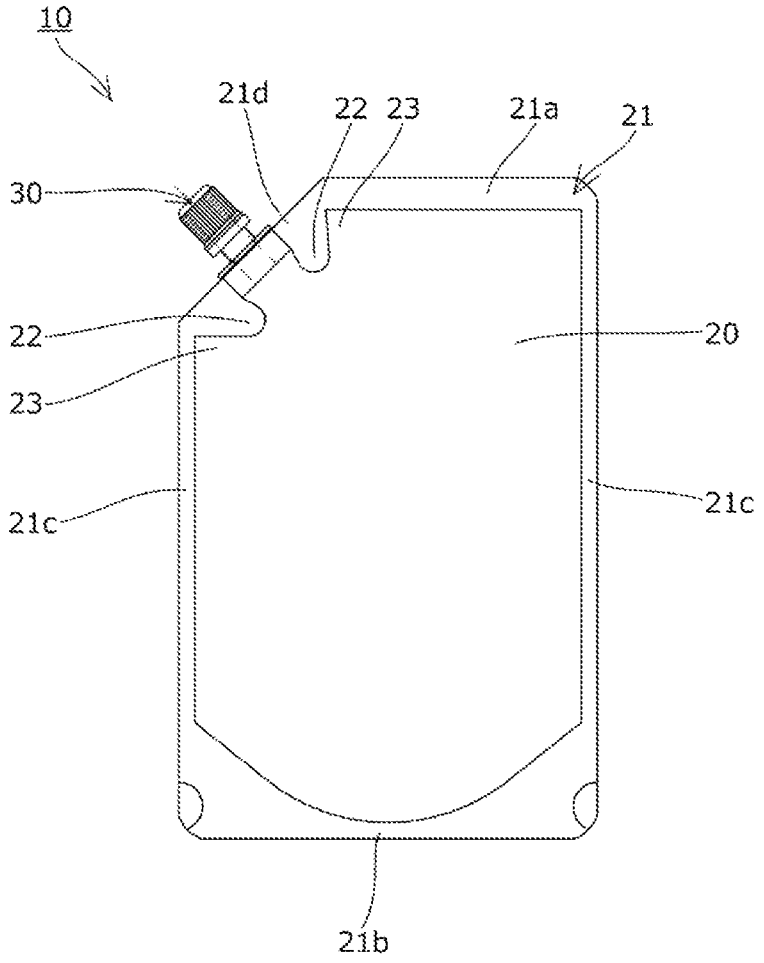
FIG. 1 is a plan view illustrating a spouted pouch according to a first embodiment of the present invention.

10 Spouted pouch
20 Pouch body
21 Outer edge seal portion
21*a* Upper edge seal portion
21*b* Lower edge seal portion
21*c* Side edge seal portion (first side edge seal portion, second side edge seal portion)
21*d* Oblique edge seal portion (attachment seal portion)
21*e* Second oblique edge seal portion
22 Flow path control seal portion
22*a* Action point portion
23 Unsealed portion
24 Position mark
25 Gripping portion
25*a* Unsealed portion
25*b* Slit
25*c* Cut
25*d* Hole

30 Spout
31 Spout body
31*a* Spout attachment base portion
32 Cap
A Imaginary line
R Film spaced region

DESCRIPTION OF EMBODIMENTS

A spouted pouch 10 according to a first embodiment of the present invention will be described below with reference to the drawings.

As illustrated in FIG. 1, the spouted pouch 10 is configured that a spout 30 functioning as a pouring outlet is attached to a bag-like pouch body 20 in which the outer edges of laminated films are thermally welded to form an outer edge seal portion 21, to contain liquid contents such as detergent and shampoo.

Each constituent element of the spouted pouch 10 will be described below with reference to FIGS. 1 to 3.

First, the pouch body 20 has an overall shape as a standing pouch that includes an upper edge portion, a lower edge portion, a pair of side edge portions (a first side edge portion, a second side edge portion), and an oblique edge portion formed by cutting out a corner between the upper edge portion and one of the side edge portions (the first side edge portion), as illustrated in FIG. 1, which are formed by using laminated films composed of two front and back body materials and a bottom material bent in an inverted V shape to thermally weld the bottom material between the two body materials.

The outer edge seal portion 21 is formed continuously along each edge portion of the body material of the pouch body 20, and includes, as illustrated in FIG. 1, an upper edge seal portion 21*a* formed in a band shape along the upper edge portion, a lower edge seal portion 21*b* formed in a band shape along the lower edge portion, side edge seal portions (the first side edge seal portion, the second side edge seal portion) 21*c* formed in a band shape along the side edge portions, and an oblique edge seal portion 21*d* formed in a band shape along the oblique edge portion.

Figure 2:
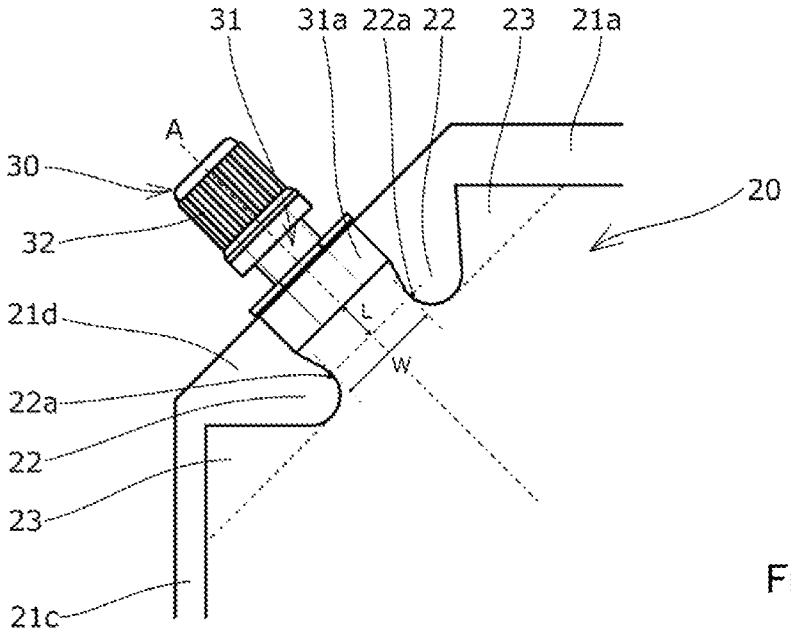
FIG. 2 is a partially enlarged view illustrating the spouted pouch.

The spout 30 is composed of a spout body 31 and a cap 32, and is attached to the oblique edge portion of the pouch body 20 as illustrated in FIGS. 1 and 2. Specifically, at the oblique edge portion of the pouch body 20, a spout attachment base portion 31*a* having a rhombus shape as a transverse sectional shape (not illustrated) is placed between the front and back films of the pouch body 20 and then the front and back films are welded to form the oblique edge seal portion 21*d*, and also the spout 30 is attached at the oblique edge portion of the pouch body 20.

In this way, in the present embodiment, the oblique edge portion of the pouch body 20 functions as an attachment edge portion to which the spout 30 is attached, and the oblique edge seal portion 21*d* functions as an attachment seal portion formed along the attachment edge portion.

Figure 3:
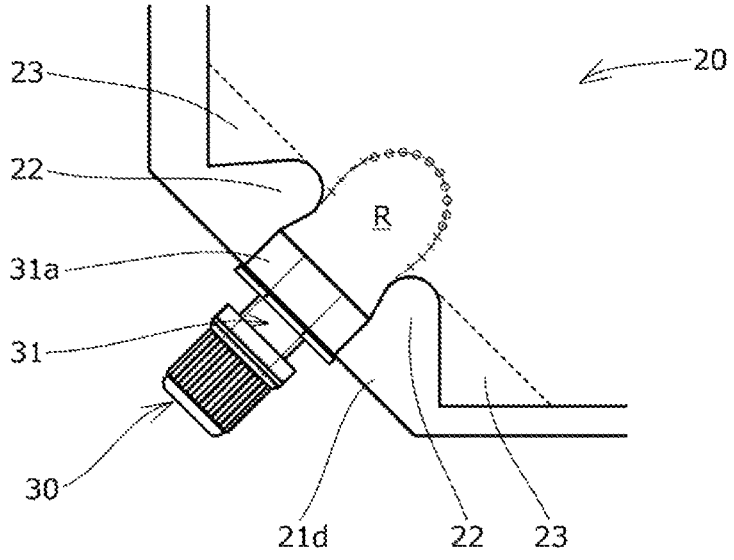
FIG. 3 is an explanatory view for explaining an action at the time of pouring liquid contents.

As illustrated in FIGS. 1 to 3, the pouch body 20 is provided with a pair of flow path control seal portions 22 formed by thermally welding the front and back films to control the flow path of the liquid contents.

As illustrated in FIG. 2, the pair of flow path control seal portions 22 is formed so as to continuously protrude toward the inside of the outer edge seal portion 21 from the oblique edge seal portion 21*d* on both right and left sides across an imaginary line A extending the center axis of the spout body 31.

Each of the flow path control seal portions 22 is formed on the left and right with the imaginary line A as a reference.

As illustrated in FIG. 2, each of the flow path control seal portions 22 has an action point portion 22*a* that is at a position farthest from the spout 30 (the spout attachment base portion 31*a*) in an extending direction of the imaginary line A out of portions closest to the imaginary line A. The action point portion 22*a* is a position that strongly influences the form aspect (shape, range, etc.) of the film spaced region R described later in the flow path control seal portion 22.

Further, as illustrated in FIG. 2, an unsealed portion 23 where the front and back films are not adhered is formed at a position adjacent to a side portion of each of the flow path control seal portions 22 on an opposite side to the imaginary line A in a direction orthogonally crossing the imaginary line A. These unsealed portions 23 communicate with a housing space in the pouch body 20 that contains the liquid contents.

Next, the effect of the spouted pouch 10 of the present embodiment will be described below with reference to FIG. 3.

First, in the present embodiment, the pair of flow path control seal portions 22 are formed on both left and right sides across the imaginary line A. As a result, as illustrated in FIG. 3, the film spaced region R where the front and back films are spaced from each other is formed due to the thickness of the spout attachment base portion 31*a* of the spout 30. In the outer edge of the film spaced region R, portions close to the spout 30 are maintained in a state where the films are closed (the state where the front and back films are in close contact with each other), and portions far from the spout 30 are maintained in a state where the films are open (the state where the front and back films are separated from each other). In FIG. 3, in the outer edge of the film spaced region R, the portions in the closed state is indicated by crosses (X); the portions in the open state are indicated by open circles (O).

In this way, the flow path control seal portions 22 are formed, thereby making it possible to restrict the film opened portions (the portions where the front and back films are separated), in the outer edge of the film spaced region R, to a narrow range which is only the tip side (O positions in the figure) of the outer edge of the film spaced region R far from the spout 30.

Thus, when poring liquid contents is performed for refilling with the liquid contents, it is possible to satisfactorily perform temporary stop of pouring liquid contents (ability to suspend the pouring), ease of adjusting a pouring force the liquid contents, and the like by pressing only the tip side of the outer edge of the film spaced region R (a portion about 5 mm to 20 mm away from the pair of flow path control seal portions 22) with the finger while the pourability at the film spaced region R where the front and back films are separated from each other is maintained.

Further, in the present embodiment, as illustrated in FIG. 3, at the side portion of each of the flow path control seal portions 22 on the opposite side to the imaginary line A in the direction orthogonally crossing the imaginary line A, an unsealed portion 23 is formed. This makes it easy for the front and back films to separate from each other on the tip side of the outer edge of the film spaced region R because of the effect of expansion of the unsealed portion 23 that the liquid contents entering the unsealed portion 23 expand the unsealed portion 23 when poring liquid contents is performed. Therefore, it is possible to ensure satisfactory pourability of the liquid contents, and in particular, to improve the ease of repouring the liquid contents when poring liquid contents is restarted.

Further, the unsealed portions 23 are formed at side portions of the respective flow path control seal portions 22 on the opposite sides to the imaginary line A, thereby making it possible to allow the liquid contents to enter at least one of the pair of unsealed portions 23 irrespective of the tilt of spouted pouch 10 when poring liquid contents is performed. Therefore, it is possible to stably obtain the effect of improving the ability to suspend the pouring and the ease of repouring due to the expansion of the unsealed portions 23.

Figure 8:
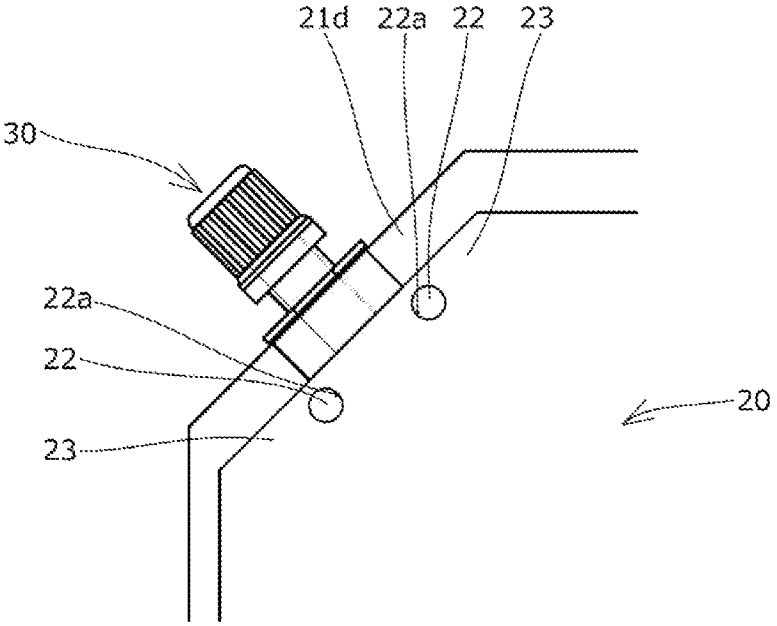
FIG. 8 is a partially enlarged view illustrating a second modified example of the flow path control seal portion.

Further, each of the flow path control seal portions 22 is formed continuously with the oblique edge seal portion 21*d* serving as the attachment seal portion, thereby making it possible to stably ensure the adhesion strength between the front and back films at each of the flow path control seal portions 22. Further, as illustrated in FIG. 8 described later, it is possible to prevent the liquid contents from leaking into the inside of the film spaced region R from between the flow path control seal portion 22 and the attachment seal portion 21*d* when poring liquid contents is stopped, as compared with the case where each of the flow path control seal portions 22 is formed at a position independently away from the attachment seal portion (the oblique edge seal portion 21*d*).

Next, a spouted pouch 10 according to a second embodiment of the present invention will be described with reference to FIG. 4. Here, in the second embodiment, the partial configuration is exactly the same as in the first embodiment described above, so that the description of the configuration other than the difference is omitted.

In the first embodiment, as illustrated in FIG. 2, the unsealed portion 23 is formed at the side portion of each of the flow path control seal portions 22 on the opposite side to the imaginary line A. By contrast, in the second embodiment, the unsealed portion 23 is not formed as illustrated in FIG. 4.

In other words, in the second embodiment, the entirety of each of the flow path control seal portions 22 is formed continuously with the upper edge seal portion 21*a* and the side edge seal portion 21*c* (which are adjacent to the oblique edge seal portion 21*d* serving as the attachment seal portion) in the direction orthogonally crossing the imaginary line A.

Next, an experimental example carried out to confirm the relationship between setting of the dimensions of the respective parts of the spouted pouch 10 and the ability to suspend poring liquid contents and the ease of repouring the liquid contents will be described below with reference to FIGS. 2, 4, and 5.

First, in the present experimental example, a length dimension L from the bottom surface of the spout attachment base portion 31*a* to the action point portion 22*a* in the extending direction of the imaginary line A and a width dimension W between the action point portions 22*a* of the pair of flow path control seal portions 22 in the direction orthogonally crossing the imaginary line A were changed to a variety of values as indicated in a table of FIG. 5 to confirm the ability to suspend poring liquid contents by griping the tip side of the film spaced region R with the fingers and the ease of repouring the liquid contents when poring liquid contents is restarted by releasing the griping with the fingers. It is noted that in the table illustrated in FIG. 5, the numerical values described on the left side of the actual dimension values of the width dimension W or the length dimension L represent ratios of the width dimension W or the length dimension L to a thickness dimension X of the spout attachment base portion 31*a* in a direction orthogonally crossing a plane direction of the pouch body 20.

Test items and an evaluation method used in the experimental examples are as follows.

<Test Item>

Size of pouch body 20: Standing pouch with width 200 mm×height 300 mm

Layer constitution of the films of pouch body 20: PET (polyethylene terephthalate) of 12 μm/NY (nylon) of 15 μm/PE (polyethylene) of 150 μm, from the outer layer side Diameter of pouring hole of spout 30: Φ8.6

Thickness dimension X of spout attachment base portion 31*a*: 11.7 mm

Figure 4:
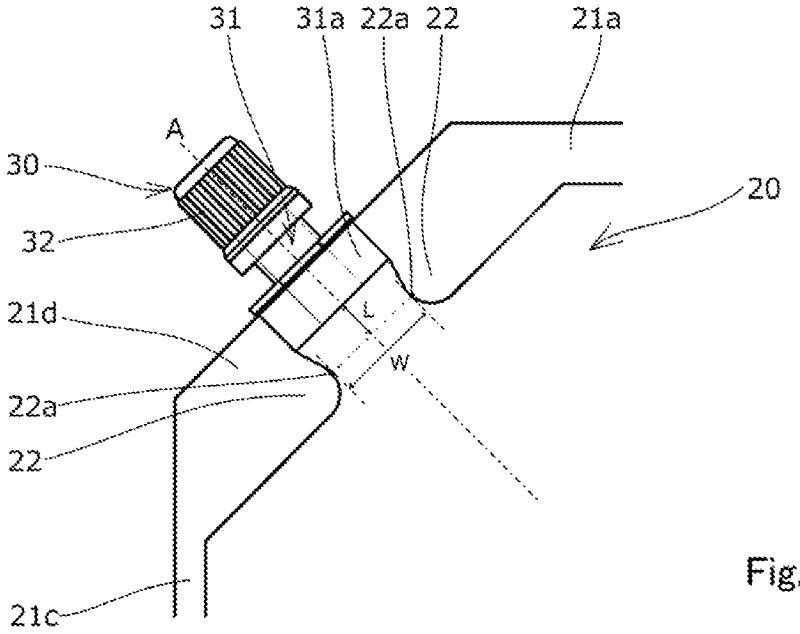
FIG. 4 is a partially enlarged view illustrating a spouted pouch according to a second embodiment.

Seal form of oblique edge seal portion 21*d* of spouted pouch 10: with unsealed portion 23 (FIG. 2), no unsealed portion (FIG. 4)

Liquid contents: 1 kg of water

<Evaluation Method>

The ability to suspend the pouring was evaluated as follows: "O" (open circle) for the case where poring liquid contents was stopped and "X" (cross) for the case where poring liquid contents could not be stopped; the ease of repouring was evaluated as follows: "O" for the case where the flow rate of repouring was approximately the same as compared with no flow control seal portion, "Δ" (triangle) for the case where a flow rate of 70% to 80% was maintained during repouring, and "X" for the case where the flow rate of repouring was as low as less than 50%.

The results of the above experimental example are illustrated in FIG. 5. From the results of the experimental example, the following can be read.

First, it was observed that the thickness dimension X, the length dimension L, and the width dimension W in both the spouted pouches 10 with and without the unsealed portion 23 formed are preferably set to satisfy relationships of W/X=1.2 to 2.0, and L/X=0.3 to 1.5.

That is, in the above case, it was confirmed that satisfactory results can be obtained for both the ability to suspend poring liquid contents and the ease of repouring the liquid contents.

The above ranges of W/X=1.2 to 2.0 and L/X=0.3 to 1.5 are ranges surrounded by thick lines in the table illustrated in FIG. 5.

Further, in addition to satisfying the above relationships, it was observed that the thickness dimension X, the length dimension L, and the width dimension W are preferably set to satisfy a relationship of W/X=0.3 L/X+a (a=1.11 to 1.55). In this case, more stable, satisfactory results are obtained for both the ability to suspend the pouring and the ease of repouring.

Further, it was observed that the thickness dimension X, the length dimension L, and the width dimension W are preferably set to satisfy relationships of W/X=0.045X+0.97 and L/X=0.15X−1.36. In this case, more stable, satisfactory results are obtained for both the ability to suspend the pouring and the ease of repouring.

In the experimental example described above, the film thickness of the pouch body 20 is described as being 177 μm (12 μm PET/15 μm NY/150 μm PE). However, in a case where the film thickness of the pouch body 20 is set to 80 μm to 210 μm, it was confirmed that the same result as the experimental results illustrated in FIG. 5 can be obtained. Since when the film thickness is less than 80 μm, the ability to suspend the pouring decreases, and when the film thickness exceeds 210 μm, the amount of repouring decreases, it is only necessary to set the above-described range of the film thickness.

Further, the experimental results illustrated in FIG. 5 are the results for the case where the thickness dimension X is set to 11.7 mm, while it was confirmed that the same results as the experimental results illustrated in FIG. 5 can be obtained also for the case where the diameter of the pouring hole of the spout 30 is increased and the thickness dimension X is set to 18.4 mm. Accordingly, it was confirmed that even when the thickness dimension X changes, it is only necessary to set the thickness dimension X, the length dimension L, and the width dimension W to satisfy the same relationships as in the case of 11.7 mm.

The embodiments of the present invention have been described above in detail. However, the present invention is not limited to the above-described embodiments, and various design changes can be made without departing from the invention defined in the claims.

For example, the spouted pouch 10 may be configured by any combination of the respective configurations of the plurality of embodiments described above and a plurality of modified examples described later.

Further, the specific aspect of the pouch body 20 may be of various ways, and its specific examples include a body in which synthetic resin films such as polyester, polypropylene, polyamide, polyethylene, polybutylene terephthalate, or ethylene-vinyl alcohol copolymer, or known synthetic resin films such as coating films or vapor deposition films in which a gas barrier property or moisture barrier property is imparted to the above synthetic resin films, a body formed by laminating sheets of paper or aluminum foil on a synthetic resin film, and the like.

Further, in the above-described embodiments, the spouted pouches 10 have been described as being used for refill containers. However, the specific use of the spouted pouch 10 is not limited to them, and the spouted pouches 10 of the present embodiments may be used as, for example, containers, not to be used for refilling, for containing water, seasoning, and the like.

Figure 13:
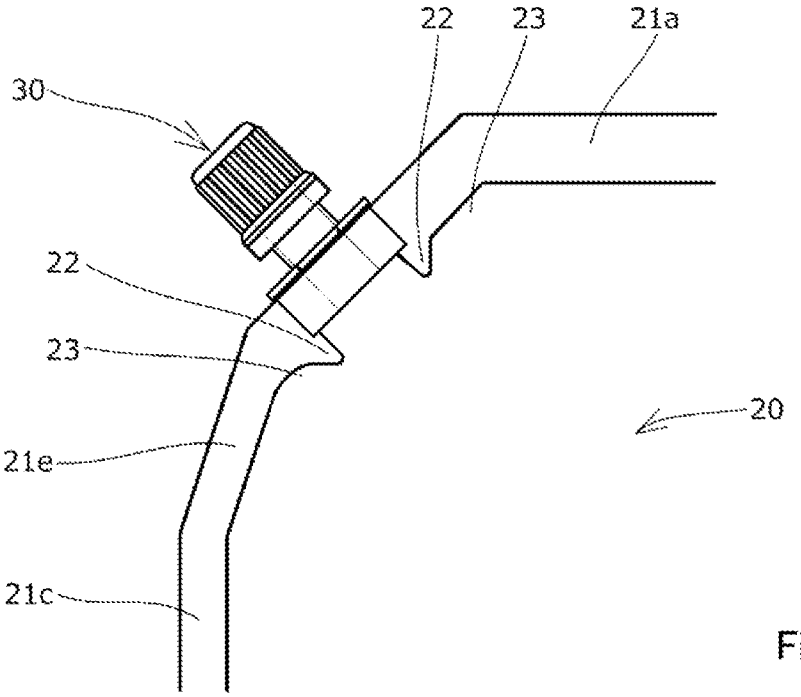
FIG. 13 is a partially enlarged view illustrating a modified example of the shape of the pouch body.

Further, in the above-described embodiments, the pouch body 20 has been described as having a whole shape having the upper edge portion, the lower edge portion, the pair of side edge portions, and the oblique edge portion. However, the specific shape of the pouch body 20 is not limited to them, and the pouch body 20 may have any shape such as, for example, a square shape or a trapezoidal shape as a whole shape, an irregular shape partially ragged, or the like. Further, additional processing may be made in the vicinity of the spout 30 so as to facilitate the work of pressing the tip side of the outer edge of the film spaced region R with the fingers when refilling with the liquid contents is performed. For example, as illustrated in FIG. 13, a processing is performed such that an inclined portion (a second oblique edge seal portion 21*e*) is further provided between the oblique edge portion (the attachment edge portion) and the first side edge seal portion 21*c* of the pouch body 20 in order to reduce the distance from the first side edge seal portion 21*c* to the film spaced region R, thereby allowing easy gripping with two fingers. This makes it possible to allow more satisfactory refilling work.

Further, in the above-described embodiments, the pouch body 20 has been described as being of a standing pouch type. However, it may have various forms such as a pillow type pouch, a gusset type pouch, a flat pouch and the like. Further, as in the above-described embodiments, all (four sides) of the edge portion of the laminated films maybe thermally welded, or in the case where the pouch body 20 is formed by folding one laminated film, and the like, two or three sides of the edge may be thermally welded without thermally welding the other portion of the edge.

Figure 6:
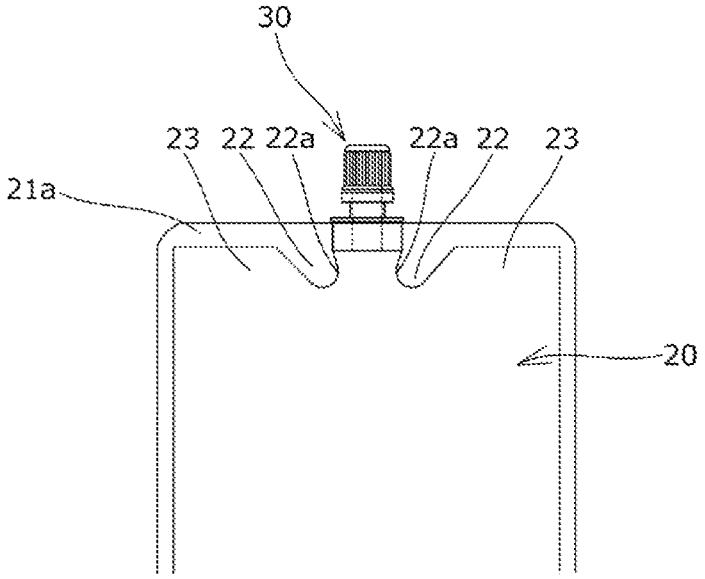
FIG. 6 is a plan view illustrating a modified example of a spouted pouch.

In the above-described embodiments, the spout 30 has been described as being attached at the oblique edge portion of the pouch body 20 as illustrated in FIG. 2. However, the attachment position of the spout 30 is not limited to this. For example, as illustrated in FIG. 6, the spout 30 may be attached at the upper edge portion of the pouch body 20 to function as the attachment edge portion, and the upper edge seal portion 21*a* may function as the attachment seal portion formed along the attachment edge portion.

Figure 7:
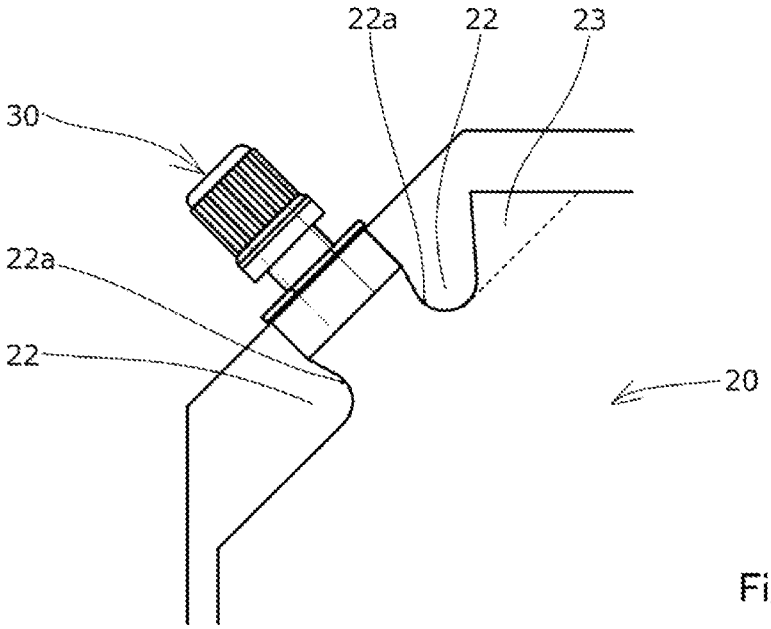
FIG. 7 is a partially enlarged view illustrating a first modified example of a flow path control seal portion.

Further, in the above-described embodiments, the unsealed portions 23 have been described as being formed adjacent to the respective flow path control seal portions 22. However, as illustrated in FIG. 7, the unsealed portion 23 has only to be formed adjacent to any one of the flow path control seal portions 22. In the embodiment illustrated in FIG. 7, the wide control seal portion 22 is formed on the side edge portion side of the pouch body 20, and the unsealed portion 23 is formed only on the upper edge portion 21*a* side. With this configuration, performing the refilling work of the liquid contents with the unsealed portion 23 side positioned on the mouth portion side of the product makes it possible to allow more satisfactory refilling work without residual liquid of the liquid contents remaining in the unsealed portion 23 in the pouch.

Further, in the above-described embodiments, each of the flow path control seal portions 22 has been described as being formed continuously with the attachment seal portion (the oblique edge seal portion 21*d*). However, the specific aspect of the flow path control seal portion 22 is not limited to this, and as illustrated in FIG. 8, each of the flow path control seal portions 22 may be formed at a position independently away from the attachment seal portion (the oblique edge seal portion 21*d*).

Further, in the above-described embodiments and modified examples, each of the flow path control seal portions 22 has been described as being composed of one seal portion which is continuous with or independent from the attachment seal portion. However, each of the flow path control seal portions 22 may be composed of two or more seal portions which are continuous with or independent from the attachment seal portion.

Figure 9:
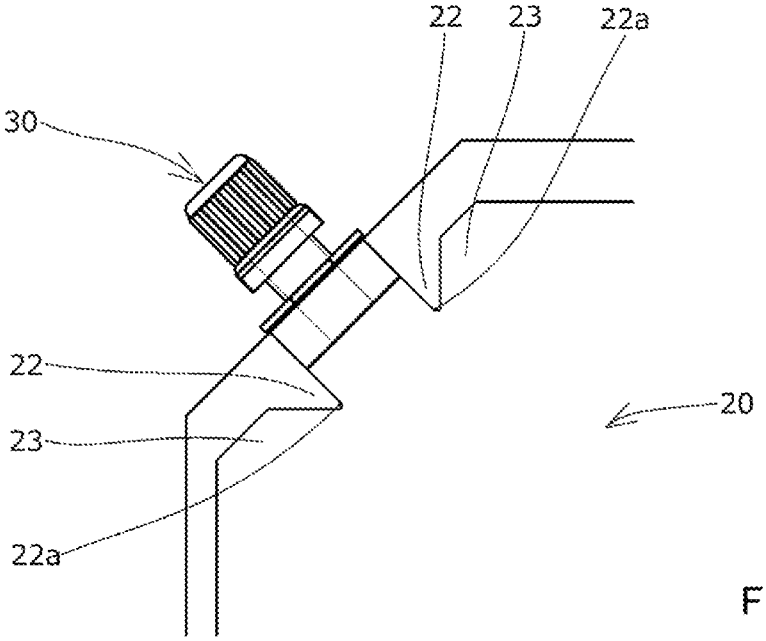
FIG. 9 is a partially enlarged view illustrating a third modified example of the flow path control seal portion.

Further, the specific shape of the flow path control seal portion 22 may be any shape, and for example, in the example illustrated in FIG. 2, the inner tip portion of each of the flow path control seal portions 22 is formed in an R shape (round), while the inner tip portion of each of the flow path control seal portions 22 may be formed to have an acute angle, as an example illustrated in FIG. 9.

Further, in the above-described embodiments, each of the flow path control seal portions 22 is formed on the left and right with respect to the imaginary line A as a reference. However, each of the flow path control seal portions 22 may be symmetric or different on both sides.

Figure 10:
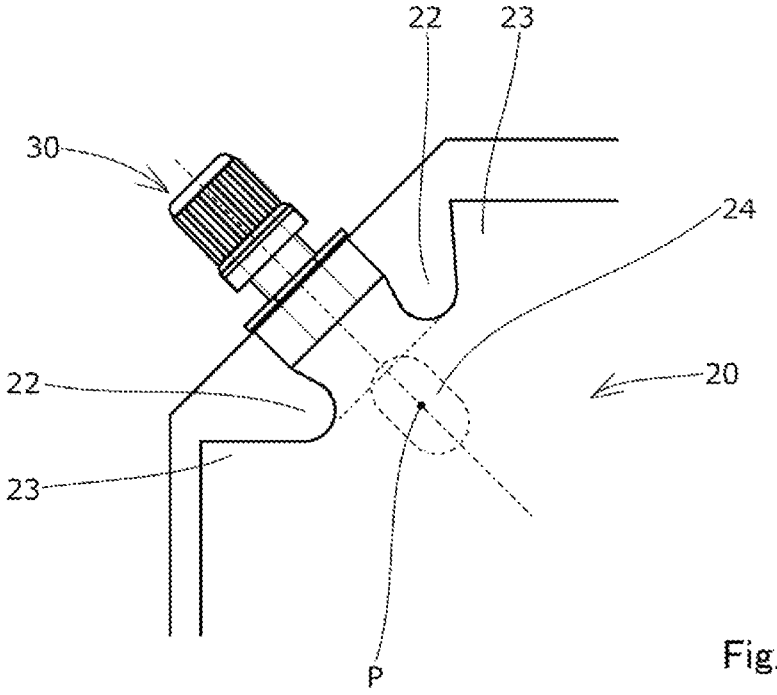
FIG. 10 is a partially enlarged view illustrating a modified example of a pouch body.

Further, as a modified example, as illustrated in FIG. 10, the pouch body 20 may be provided with a position mark 24 indicating a position to press with the finger. The position mark 24 is formed on the imaginary line A so as to include a position P located on the inner side (center side) in the pouch plane direction (to extent of about 5 mm to 20 mm) away from the pair of flow path control seal portions 22, and more preferably, it is formed around the position P as the center. With this configuration, it is possible to securely press or release the optimum position with the finger or release the position when poring liquid contents is suspended or when repouring of liquid contents is performed. It is noted that the specific aspect of the position mark 24 may be anything as long as it can be visually recognized from the outside, such as a mark which is printed on the surface of the film, a mark which is formed by embossing the film, or the like.

Further, in the present embodiment, the spout attachment base portion 31*a* has described as having a rhombus shape. However, the spout attachment base portion 31*a* may have any known shape.

Figure 11:
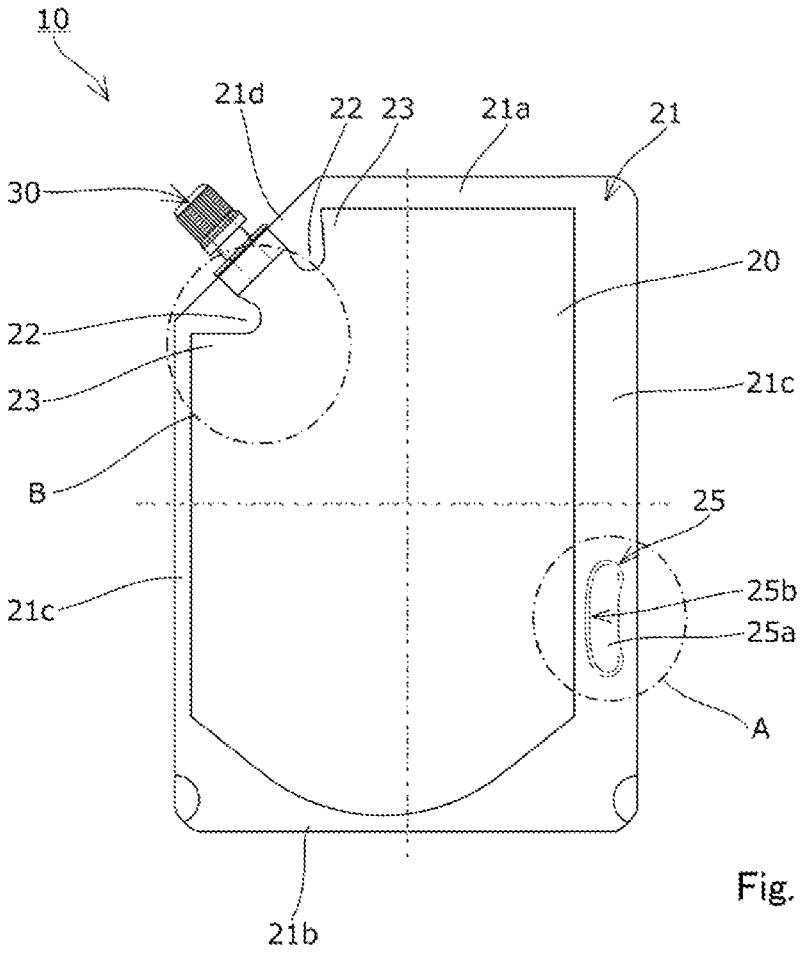
FIG. 11 is a plan view illustrating a modified example in which a gripping portion is formed in the pouch body.

Further, as a modified example, as illustrated in FIGS. 11 and 12, a gripping portion 25 indicating a grip position of the spouted pouch 10 for the user may be provided.

The forming position of the gripping portion 25 may be any position as long as it can guide the user on how to hold the spouted pouch 10, but when the spout 30 is attached at the oblique edge portion formed at the corner between the upper edge portion and the first side edge portion, the upper edge portion (in particular, a portion closer to the first side edge portion than to the center of the upper edge portion), or the first side edge portion (in particular, a portion closer to the center of the upper edge portion than to the first side edge portion), the gripping portion 25 is preferably formed at the second side edge seal portion 21*c*, and in particular, preferably formed at a portion closer to the lower edge portion 21*b* than to the center of the second side edge seal portion 21*c* so that the center of the gripping portion 25 or the entire gripping portion 25 is positioned, as illustrated in FIG. 11.

In addition, when a position A in FIG. 11 in the vicinity of the gripping portion 25 is gripped with one hand (for example, the right hand) of the user, the gripping portion 25 formed at the above-described position naturally guides the other hand (for example, the left hand) of the user to a position B in FIG. 11 in the vicinity of the spout 30 as the position to support the spouted pouch 10. Thus, it is possible to guide the user on how to hold the spouted pouch 10 to grip the tip side of the outer edge of the film spaced region R described above in the vicinity of the spout 30 with the fingers while the user lifts the spouted pouch 10. Therefore, the user can easily operate temporary stop of poring liquid contents and restart of poring liquid contents.

Further, the specific aspect of the gripping portion 25 may be anything as long as it allows the user to easily grip the spouted pouch 10. For example, as illustrated in FIGS. 12A to 12D, the gripping portion 25 may be configured such that a slit 25*b* is formed so as to (partially) surround a part of the second side edge seal portion 21*c*, thereby making it possible to allow the user to insert the finger(s) into the part surrounded by the slit 25*b*. Further, as illustrated in FIG. 12E, the gripping portion 25 may be configured such that one or more holes 25*d* is formed in the second side edge seal portion 21*c*, and/or the gripping portion 25 may be configured such that a thick portion shaped by thickening a part of the pouch body 20 is formed, but not illustrated.

Further, as illustrated in FIG. 11 and FIGS. 12A to 12E, an unsealed portion 25*a* may be formed in the second side edge seal portion 21*c*, and the slit 25*b* and the hole 25*d* may be formed in the unsealed portion 25*a*. In this case, since the front and back films are not welded at the unsealed portion 25*a*, it is possible to allow the user's finger (s) inserted in the slit 25*b* or the hole (s) 25*d* to come in soft contact with the film.

Figure 12A:
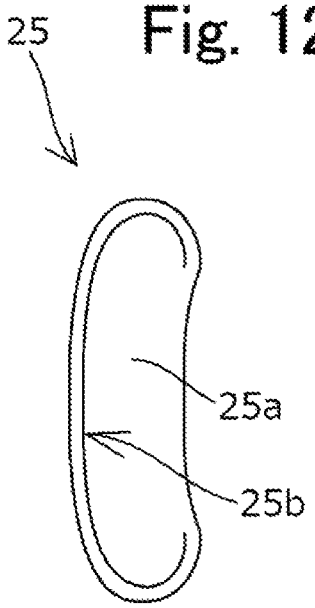
FIG. 12A is an explanatory view illustrating a modified example of the gripping portion.
Figure 12B:
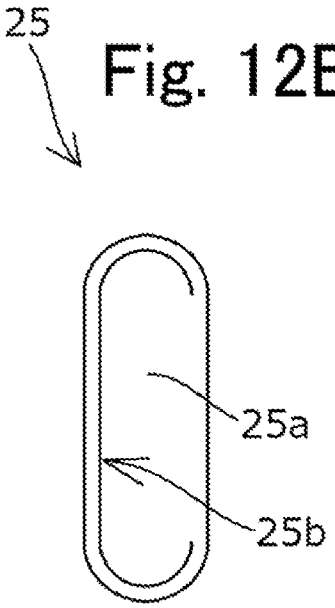
FIG. 12B is an explanatory view illustrating a modified example of the gripping portion.
Figure 12C:
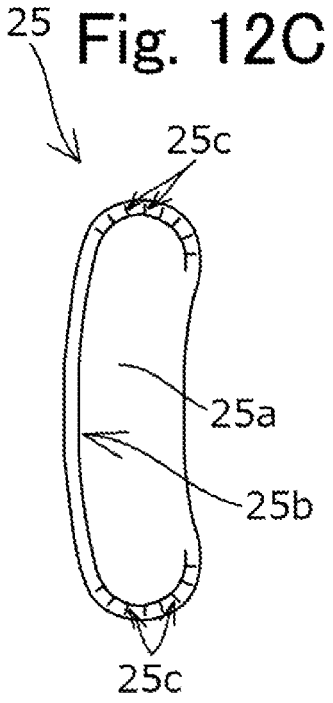
FIG. 12C is an explanatory view illustrating a modified example of the gripping portion.
Figure 12D:
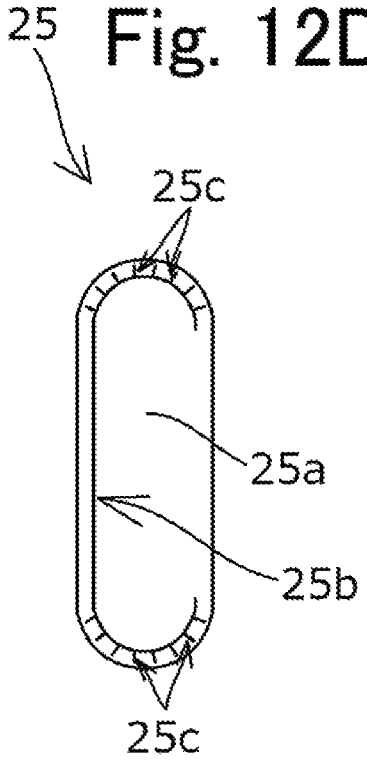
FIG. 12D is an explanatory view illustrating a modified example of the gripping portion.
Figure 12E:
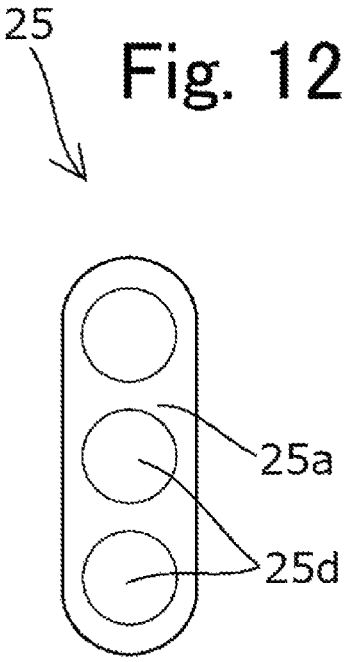
FIG. 12E is an explanatory view illustrating a modified example of the gripping portion.

Further, as illustrated in FIGS. 12C and 12D of, a plurality of cuts 25*c* continuous on the slit 25*b* may be formed on the outer circumferential side of the slit 25*b*. In this case, it is possible to allow the user's finger(s) inserted in the slit 25*b* to come in softer contact with the film.

Further, in the above-described embodiments, the distances (L) from the spout attachment base portion 31*a* to the respective action point portions 22*a* on the left and right sides in the extending direction of the imaginary line A have been described as being equal. However, each of the action point portions 22*a* may be shifted in the extending direction of the imaginary line A.

The invention claimed is:

1. A spouted pouch comprising:

a pouch body comprising a front film and a back film, a spout body attached to the pouch body, and a spout attached to the spout body, wherein:

the pouch body has a first outer edge seal portion and a second outer edge seal portion formed on opposite sides of the spout body across an imaginary line extending along a center axis of the spout body, the first outer edge seal portion comprises a first oblique edge seal portion, a first side edge seal portion, an upper edge seal portion connecting the first oblique edge seal portion and the first side edge seal portion, and a first flow path control seal portion extending continuously from the first oblique edge seal portion toward an inside of the first outer edge seal portion, the second outer edge seal portion comprises a second oblique edge seal portion, a second side edge seal portion connecting directly to the second oblique edge seal portion, and a second flow path control seal portion extending continuously from the second oblique edge seal portion toward an inside of the second outer edge seal portion, the first and second oblique edge seal portions extend from the opposite sides of the spout body in a direction perpendicular to the imaginary line, the first and second side edge seal portions extend along a length of the pouch body, each of the first and second flow path control seal portions has an action point portion that is located at a position farthest from the spout body in an extending direction of the imaginary line, out of portions closest to the imaginary line, the spout body has a spout attachment base portion that is attached to a part of the outer edge seal portion such that the spout attachment base portion is interposed between the front film and the back film, the first and second flow path control seal portions abut the spout attachment base portion of the spout body, assuming that a thickness dimension of the spout attachment base portion in a direction orthogonally crossing a plane direction of the pouch body is taken as X, length dimension from the spout attachment base portion to the action point portion in the extending direction of the imaginary line is taken as L, and a width dimension between the action point portions of the first and second flow path control seal portions in a direction orthogonally crossing the imaginary line is taken as W, the thickness dimension X, the length dimension L, and the width dimension W are set so as to satisfy relationships of W/X=1.2 to 2.0 and L/X=0.3 to 1.5, the first and second flow path control seal portions form a film spaced region in a vicinity of the spout attachment base portion, the film spaced region is defined by a boundary beginning at one of the pair of action point portions and ending at the other of the pair of action point portions, the boundary having a first portion and a second portion that is farther from the spout than the first portion, in the first portion, the front film and the back film of the pouch body are in contact with each other, and in the second portion, the front film and the back film of the pouch body are separated from each other.

2. The spouted pouch according to claim 1, wherein the thickness dimension X, the length dimension L, and the width dimension W are set so as to satisfy relationships of $W/X=0.3\ L/X+a$ and $a=1.11$ to $1.55$.

3. The spouted pouch according to claim 2, wherein the thickness dimension X, the length dimension L, and the width dimension W are set to satisfy relationships of $W/X=0.045X+0.97$ and $L/X=0.15X-1.36$.

4. The spouted pouch according to claim 1, wherein a thickness of each of the front film and the back film is set to 80 to 210 μm.

5. The spouted pouch according to claim 1, wherein an unsealed portion which communicates with a housing space in the pouch body that contains the liquid contents is formed at a position adjacent to a side portion of at least one of the first and second flow path control seal portions on an opposite side to the imaginary line in the direction orthogonally crossing the imaginary line.

6. The spouted pouch according to claim 1, wherein the width dimension W is narrower than a width of the spout attachment base portion.

7. The spouted pouch according to claim 1, wherein the second portion of the boundary defining the film spaced region is at a distance of from 5 mm to 20 mm from the pair of flow path control seal portions.

8. A spouted pouch, comprising:

a pouch body, a spout body attached to the pouch body, and a spout attached to the spout body, wherein:

the pouch body has an outer edge seal portion extending from both left and right side of the spout body in a direction perpendicular to an imaginary line extending along a center axis of the spout body, the outer edge seal portion comprising a pair of oblique edge seal portions and a pair of side edge seal portions, the pair of oblique edge seal portions extending from both the left and right sides of the spout body in the direction perpendicular to the imaginary line, and the pair of side edge seal portions being adjacent to the pair of oblique edge seal portions and extending along a length of the pouch body, the pouch body has a pair of flow path control seal portions that extend continuously from the pair of oblique edge seal portions toward an inside of the outer edge seal portion on both the left and right sides of the spout body, an unsealed portion which communicates with a housing space in the pouch body that contains the liquid contents is formed on a side of at least one of the pair of flow path control seal portions opposite from the spout body in a direction orthogonally crossing the imaginary line, each of the pair of flow path control seal portions abuts the spout body, and the unsealed portion abuts the at least one of the pair of flow path control seal portions.

9. The spouted pouch according to claim 8, wherein the unsealed portion is formed on a side of both of the pair of flow path control seal portions opposite from the spout body in the direction orthogonally crossing the imaginary line.

10. The spouted pouch according to claim 8, wherein the pouch body has an attachment edge portion to which the spout is attached at a part of an outer edge of the pouch body, the outer edge seal portion has an attachment seal portion that is formed along the attachment edge portion, and each of the pair of flow path control seal portions is formed continuously with the attachment seal portion that is formed along the attachment edge portion.

11. The spouted pouch according to claim 8, wherein the pouch body is provided with a position mark indicating a position to be pressed with a finger.

12. The spouted pouch according to claim 11, wherein the position mark is formed on the imaginary line so as to include a position located on an inner side in a pouch plane direction away from the pair of flow path control seal portions.

13. The spouted pouch according to claim 12, wherein the position mark is formed around the position as a center.

14. The spouted pouch according to claim 8, wherein the outer edge seal portion further comprises an upper edge seal portion, and a lower edge seal portion, the pair of side edge seal portions are a first side edge seal portion and a second side edge seal portion, the spout is attached at the upper edge seal portion, the first side edge seal portion, or one of the pair of oblique edge seal portions that is formed by cutting a corner between the upper edge seal portion and the first side edge seal portion, and a gripping portion indicating a gripping position of the spouted pouch for a user is provided at the second side edge seal portion.

* * * * *